US012514358B2

(12) United States Patent
Schell

(10) Patent No.: US 12,514,358 B2
(45) Date of Patent: Jan. 6, 2026

(54) CARRY HANDLE FOR BULKY ARTICLES AND THE LIKE

(71) Applicant: Julie Schell, Haddonfield, NJ (US)

(72) Inventor: Julie Schell, Haddonfield, NJ (US)

( * ) Notice: Subject to any disclaimer, the term of this patent is extended or adjusted under 35 U.S.C. 154(b) by 78 days.

(21) Appl. No.: 18/167,506

(22) Filed: Feb. 10, 2023

(65) Prior Publication Data

US 2023/0248136 A1 Aug. 10, 2023

Related U.S. Application Data

(60) Provisional application No. 63/267,813, filed on Feb. 10, 2022.

(51) Int. Cl.
*A45F 3/14* (2006.01)

(52) U.S. Cl.
CPC ..... *A45F 3/14* (2013.01); *A45F 2003/142* (2013.01)

(58) Field of Classification Search
CPC . A45C 13/30; A45C 13/385; A45F 2003/142; A45F 3/02; A45F 3/14; A45F 5/10; A63C 11/025; A63C 11/026; B62B 5/0083; B62B 5/068
USPC ..... 224/258
See application file for complete search history.

(56) References Cited

U.S. PATENT DOCUMENTS 4,911,347 A * 3/1990 Wilhite ..... A45F 3/14 224/264
6,513,816 B1 * 2/2003 Kijima ..... A63B 55/60 280/DIG. 6
7,857,378 B2 12/2010 Smith
8,454,084 B2 6/2013 Lah
10,070,731 B2 9/2018 Frankel et al.
10,633,009 B2 * 4/2020 Webber ..... B62B 5/0083
2019/0159577 A1 5/2019 Tamberino
(Continued)

FOREIGN PATENT DOCUMENTS

DE 406541 C * 11/1924
DE 102006026993 A1 * 12/2007 ..... A63C 11/026
FR 555967 A * 7/1923
(Continued)

OTHER PUBLICATIONS

DE-102006026993-A1 Translation, Billmann S, Dec. 13, 2007 (Year: 2007).*
(Continued)

*Primary Examiner* — Nathan J Newhouse
*Assistant Examiner* — Matthew T Theis
(74) *Attorney, Agent, or Firm* — Lauletta Birmbaum, LLC; Kenneth R. DeRosa

(57) ABSTRACT

A carry handle for carrying one or more bulky articles is disclosed. The carry handle includes a carrying strap having a first end and a second end located opposite the first end. Holding straps are also provided and configured to be secured around the one or more bulky articles. The holding straps are attached to the first end and the second end of the carrying strap via a mechanical connector for securing the one or more bulky articles whereby the one or more bulky articles may be carried by a user. In another form, a bottom support assembly having an L-shaped configuration is provided and includes side and bottom support for the one or more bulky articles, whereby the one or more bulky articles may be transported by a user.

4 Claims, 7 Drawing Sheets

(56) References Cited

U.S. PATENT DOCUMENTS

| | | | |
|---|---|---|---|
| 2020/0087035 | A1 | 3/2020 | Reinsfelder et al. |
| 2021/0204680 | A1 | 7/2021 | Forgrave |

FOREIGN PATENT DOCUMENTS

| | | | | |
|---|---|---|---|---|
| KR | 910004303 | Y1 | 6/1991 | |
| KR | 200476869 | Y1 | 4/2015 | |
| KR | 200476870 | | 4/2015 | |
| KR | 102181190 | | 11/2020 | |
| WO | WO-2009007959 | A1 * | 1/2009 | ..... A63C 11/026 |

OTHER PUBLICATIONS

DE 406541 C Translation, Nov. 29, 1924 (Year: 1924).*
FR-555967-A Translation, Lemele, Jul. 10, 1923 (Year: 1923).*
#7050 Folding Chair With Carrying Bag.
G2j Foldable Camping Big Chair With Carry Bag (Multicolour), Polyester.

* cited by examiner

CARRY HANDLE FOR BULKY ARTICLES AND THE LIKE

CROSS REFERENCE TO RELATED APPLICATIONS

This application claims the benefit of U.S. Provisional Application No. 63/267,813 filed Feb. 9, 2022. The entire disclosure of which is incorporated herein by reference.

STATEMENT REGARDING FEDERALLY SPONSORED RESEARCH OR DEVELOPMENT

The present invention was not developed with the use of any Federal Funds, but was developed independently by the inventors.

FIELD

The present invention generally relates to the field of carry handles and more specifically relates to carry handles for bulky articles, such as collapsible portable chairs and the like.

BACKGROUND

Collapsible portable chairs have enjoyed widespread popularity because of their combination of strength, lightweight design, and portable nature. Common designs have a metal or plastic frame and a strong fabric seat, back and arm element that fit over the frame. The legs are formed by cross-linkages that collapse inward in width and depth to form a compact structure having a length comparable to the height of the chair, but with a substantially reduced width and/or height. Such a chair often is paired with an elongate, specially fitted cloth bag or sack into which the chair in the collapsed state can fit. The storage and transport bag often includes a shoulder strap.

Chairs of this type are well-known. Such chairs are often referred to as camping or beach chairs, but enjoy use at any outdoor event that does not include sufficient available seating. Such outdoor events can include parades, outdoor community events, children's sporting events, and the like.

Many people bring their lawn chairs to sporting events and other outdoor gatherings. These chairs are typically stored and transported in an outer sleeve or bag. Unfortunately, it can be a struggle for people to get these chairs back into the sleeve after the event or gathering. People may even end up tearing or ripping the sleeve.

There is a need, therefore, for a collapsible, transportable chair that avoids the inconveniences discussed above.

SUMMARY

In the invention, a carry handle for carrying one or more bulky articles is disclosed. The carry handle includes a carrying strap having a first end and a second end located opposite the first end. Holding straps are also provided and configured to be secured around the one or more bulky articles. The holding straps are attached to the first end and the second end of the carrying strap via a mechanical connector for securing the one or more bulky articles whereby the one or more bulky articles may be carried by a user. The holding strap may include an intermediate padded portion. The holding straps may be adjustable to fittingly secure the holding straps around the one or more bulky articles. The carrying handing may be adjustable to adapt to users of different sizes. Mechanical fasteners may be disposed on each end of the carrying handle to removably attach the carrying handle to the holding straps. Each holding strap may include a hook and loop fastener for adjustably securing each holding strap to the one or more bulky articles.

In another form of the invention, the carry handle includes a carrying strap. The carrying strap has a first end and a second end located opposite the first end. A top holding strap configured to be secured around the one or more bulky articles is also provided. The holding straps are attached to the first end of the carrying strap via a mechanical connector for securing the one or more bulky articles. A bottom support assembly is also provided and has an L-shaped configuration to provide side and bottom support for the one or more bulky articles, whereby the one or more bulky articles may be transported by a user. The bottom support assembly may include one or more wheels attached to an underside there to aid in transporting the one or more bulky articles. The bottom support assembly may also be provided with a bottom holding strap that is adjustable to fittingly secure the bottom holding strap around the one or more bulky articles. The top holding strap may also include a handle extending therefrom for the user to facilitate the transport of the one or more bulky articles

BRIEF DESCRIPTION OF THE DRAWINGS

The embodiments will be described in detail with reference to the following drawings in which like reference numerals refer to like elements wherein.

DETAILED DESCRIPTION

As best seen in FIGS. 1 through 4 the invention relates to a carry handle 10. The carry handle 10 comprises an elongated shoulder carrying strap or harness 12 typically fabricated from a fabric material, plastic material, synthetic rubber material or the like, such as, preferably, nylon. It should be understood that other suitable materials are contemplated by the invention and fall within the scope of the invention. The carrying handle 10 is for holding one or more bulky articles 100, such as a collapsible portable chair shown.

Figure 1:
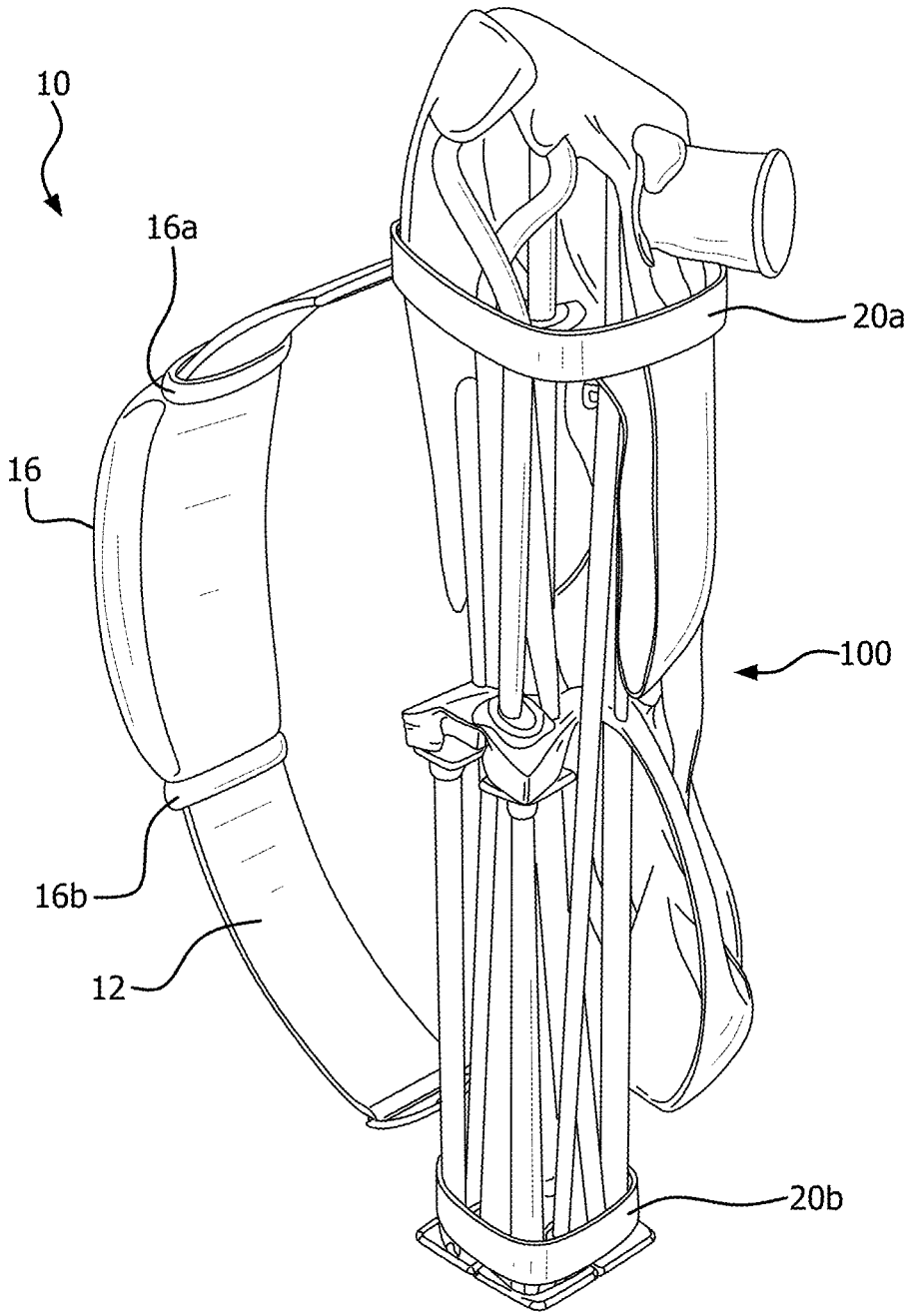
FIG. 1 is a view of the carry handle of the present invention in use.
Figure 2:
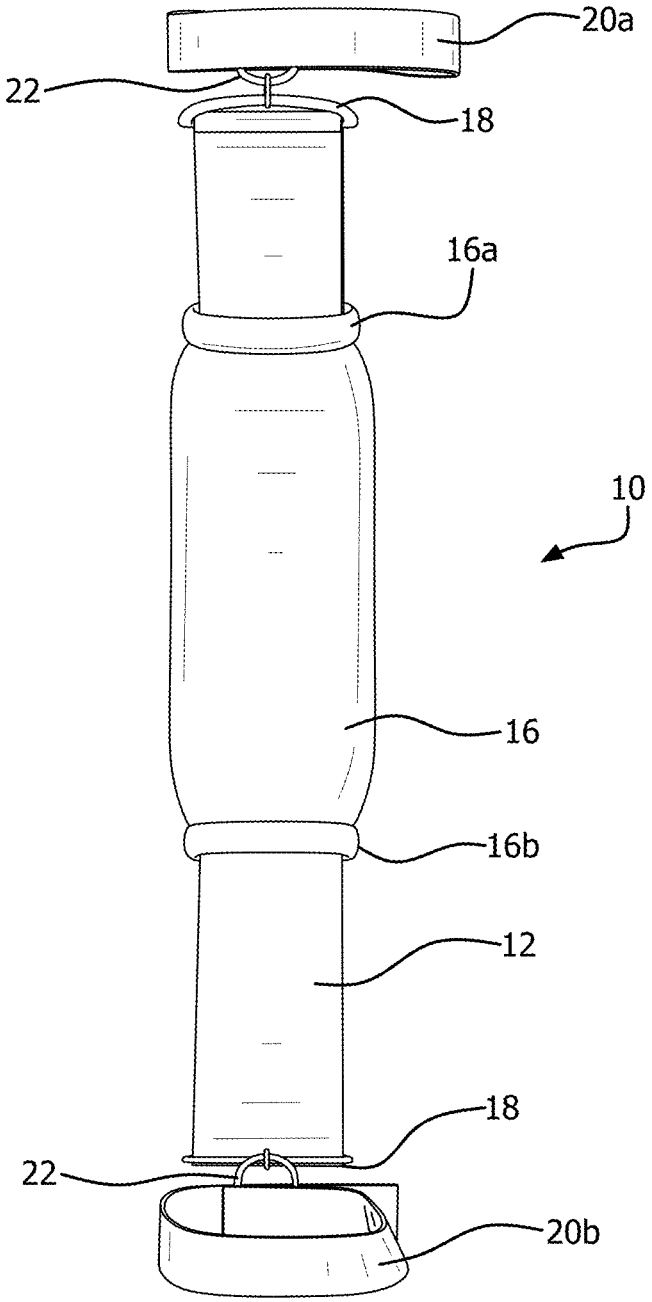
FIG. 2 is a front view of the carry handle the invention according to FIG. 1.
Figure 3:
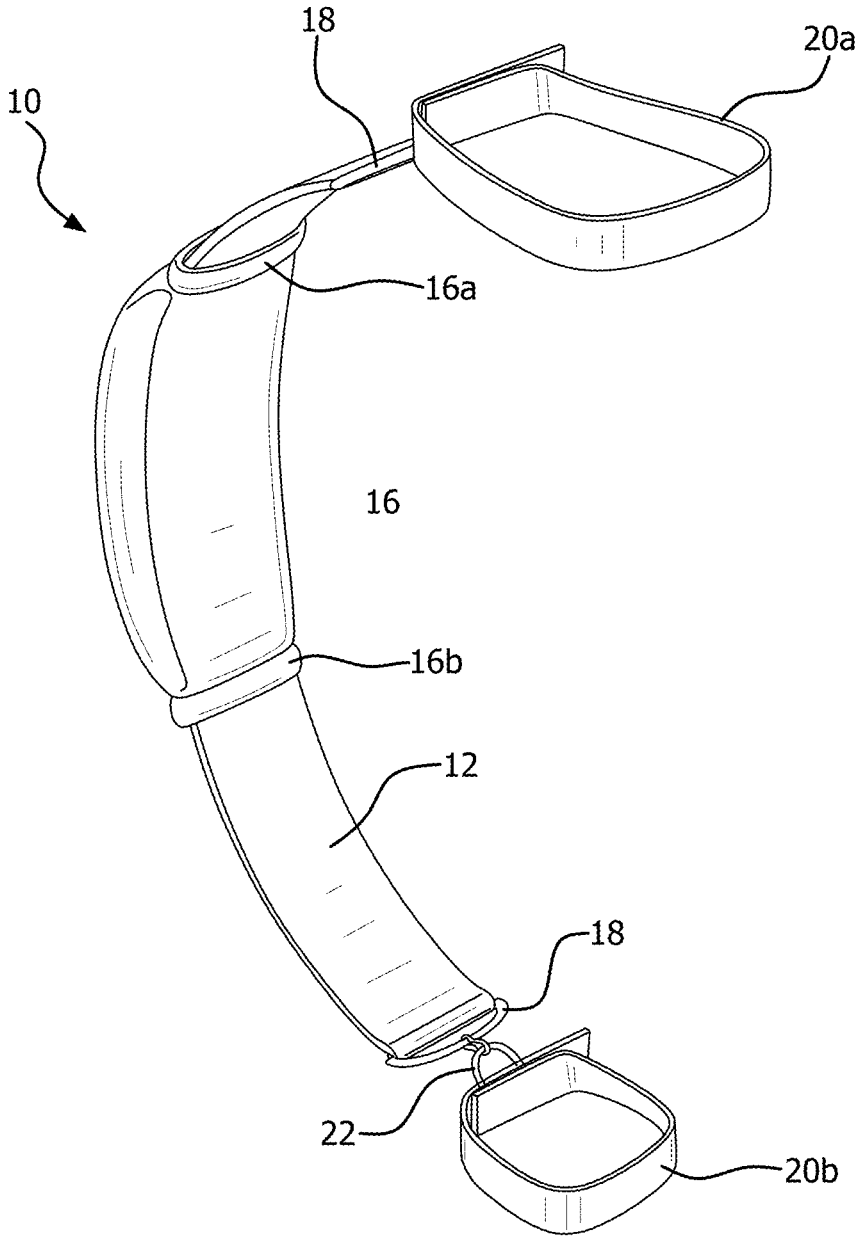
FIG. 3 is a front perspective view of the carry handle of the invention according to FIG. 1.
Figure 4:
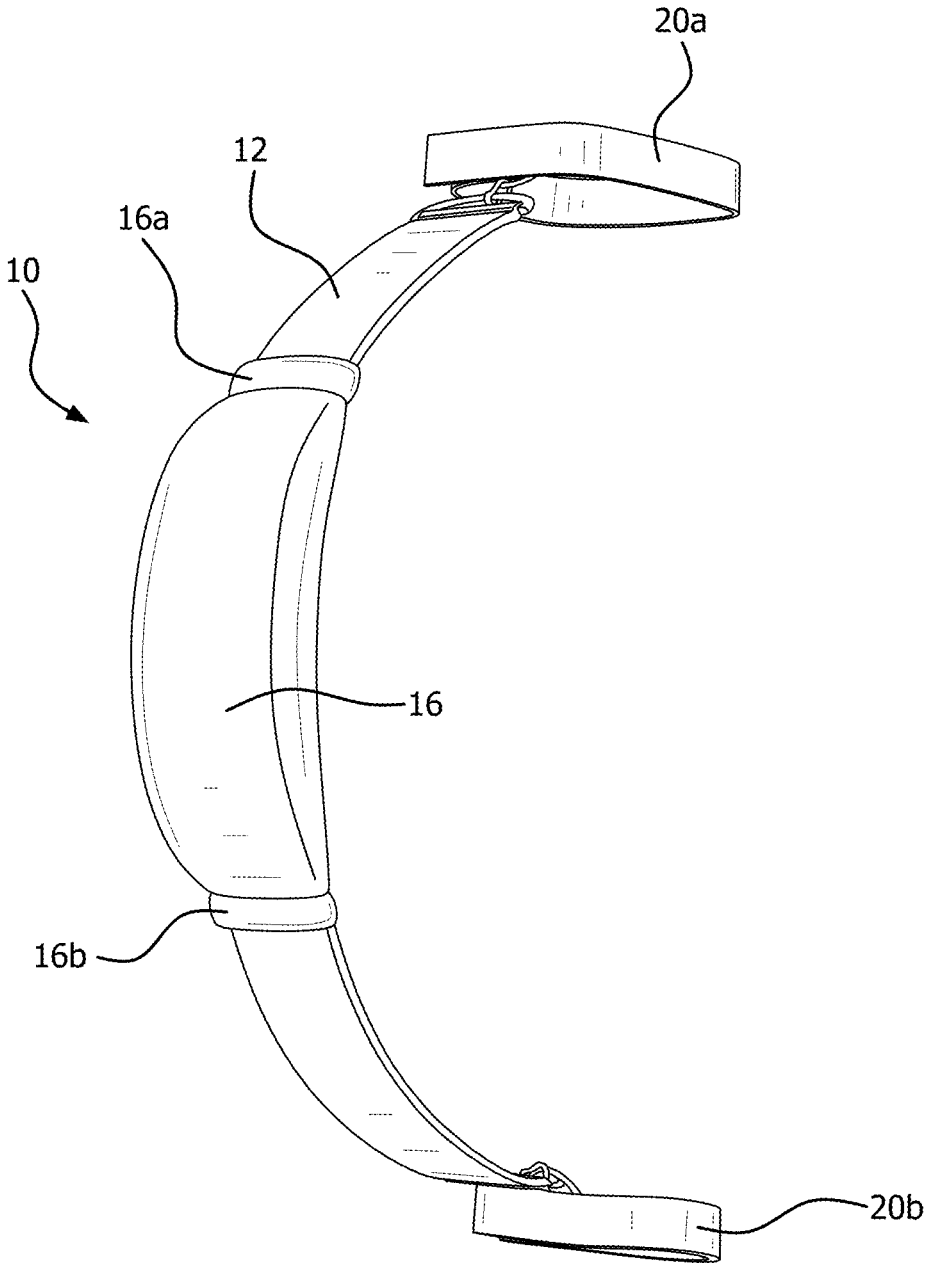
FIG. 4 is a back perspective view of the carry handle of the invention according to FIG. 1.

Referring now to FIG. 1, the collapsible, portable chair includes a tubular metal frame and a cushion fabric element. The chair in the collapsed state may be placed into a suitable chair bag, not shown, but would be known to those of ordinary skill in the art for containing collapsed portable chairs.

Referring now to FIGS. 1 through 4, the carrying strap 12 is preferably adjustable in length to accommodate differently sized users such as by the use of buckles or other adjustable mechanical fasteners and the like preferably incorporated into the mechanical fastener 18, described in better detail below. An intermediate padded portion 16 is preferably provided to facilitate the comfort of the user in using the carry handle 10 on the user's shoulder. The padded portion 16 includes opposed opening 16*a* and 16*b* through which the carrying strap 12 passes through and by which the padded portion 16 is slidably positioned on the carrying strap 12 to provide further comfort to the user and aid in the balancing of the load of the bulky article(s) 100.

A mechanical fastener 18, preferably a snap hook, as shown, is provided at either end of the carrying strap/harness 12 for attaching the carrying strap 12 to the bulky article 100. The mechanical fasteners 18 are preferably detachable and may take the form of a clasp or the like and provide the capability to adjust the length of the strap 12 by providing a buckle functionality.

A pair of flexible, adjustable holding straps 20*a* and are provided to hold the bulky article 100 to be carried, such as a portable collapsible chair or the like. The adjustable holding straps 20*a* preferably include a hook and loop fastener located on one or both sides of the adjustable holding straps 20*a* to adjustably secure the carry handle 10 to the bulky article 100. The holding straps 20*a* and 20*b* are provided with an intermediately located loop connector 22 which cooperates with the detachable fastener 18 to attach the holding straps 20*a* and 20*b* to the carrying strap 12 at each end of the carrying strap 12. The bulky article(s) 100 are often collapsible portable chairs as described above. These chairs are typically used at sporting events, concerts, camping, beach/park visits, family reunions, and the like. The handles may be embroidered with team names, family name, and the like. A pocket that can hold keys, sunscreen, and the like may also be provided.

Each holding strap 20*a* and 20*b* is provided with a connector 18, such as the D-ring and clasp shown or some other suitable mechanical connector at one end cooperating with another mechanical connector 22, such as the loops shown or the like. It should be understood that other suitable fasteners are contemplated and fall within the scope of the present invention.

A carry bag (not shown) may also be provided to hold the bulky carried item within.

Figure 5:
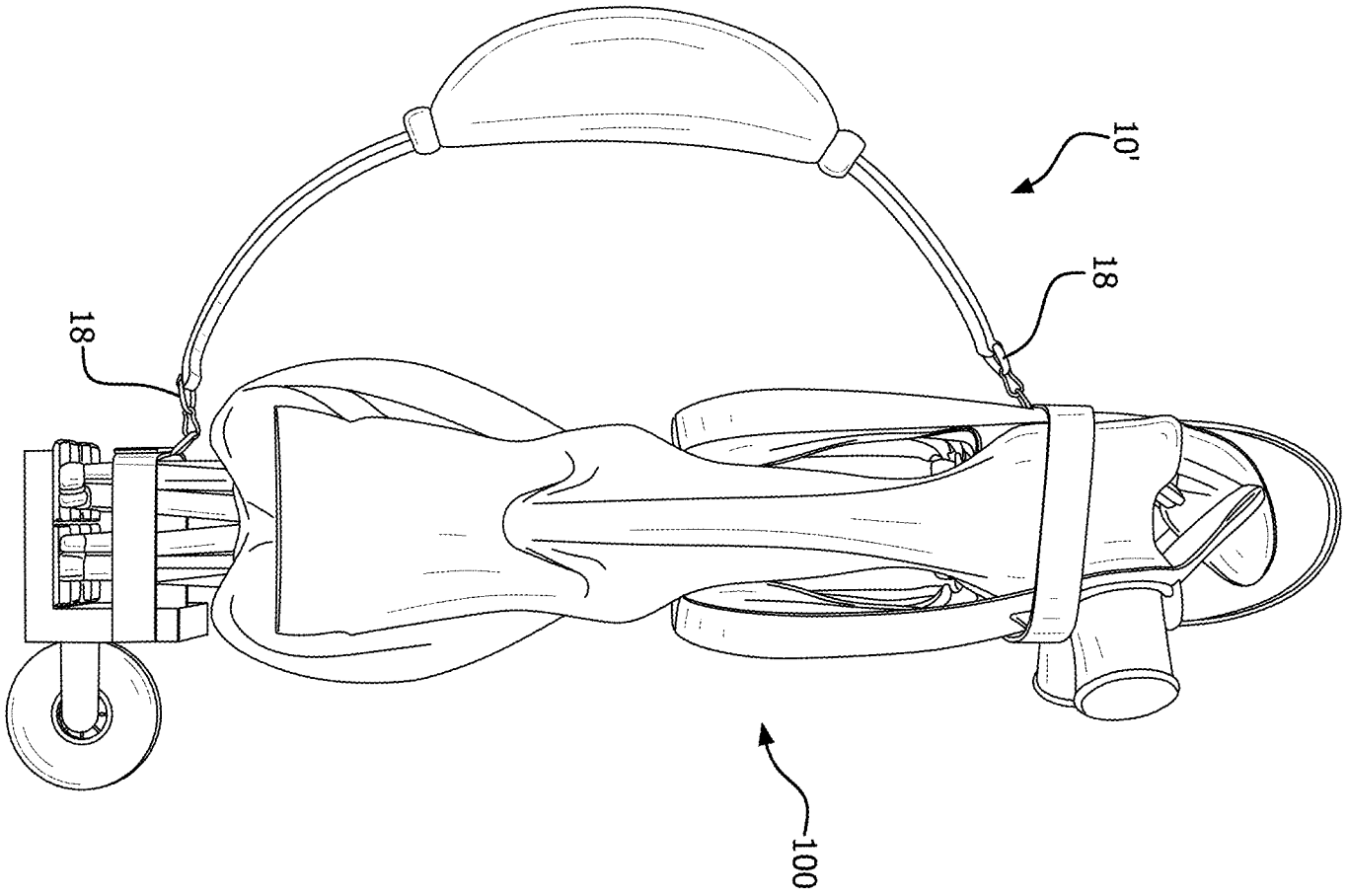
FIG. 5 is an alternate embodiment of the carry handle invention in use.
Figure 6:
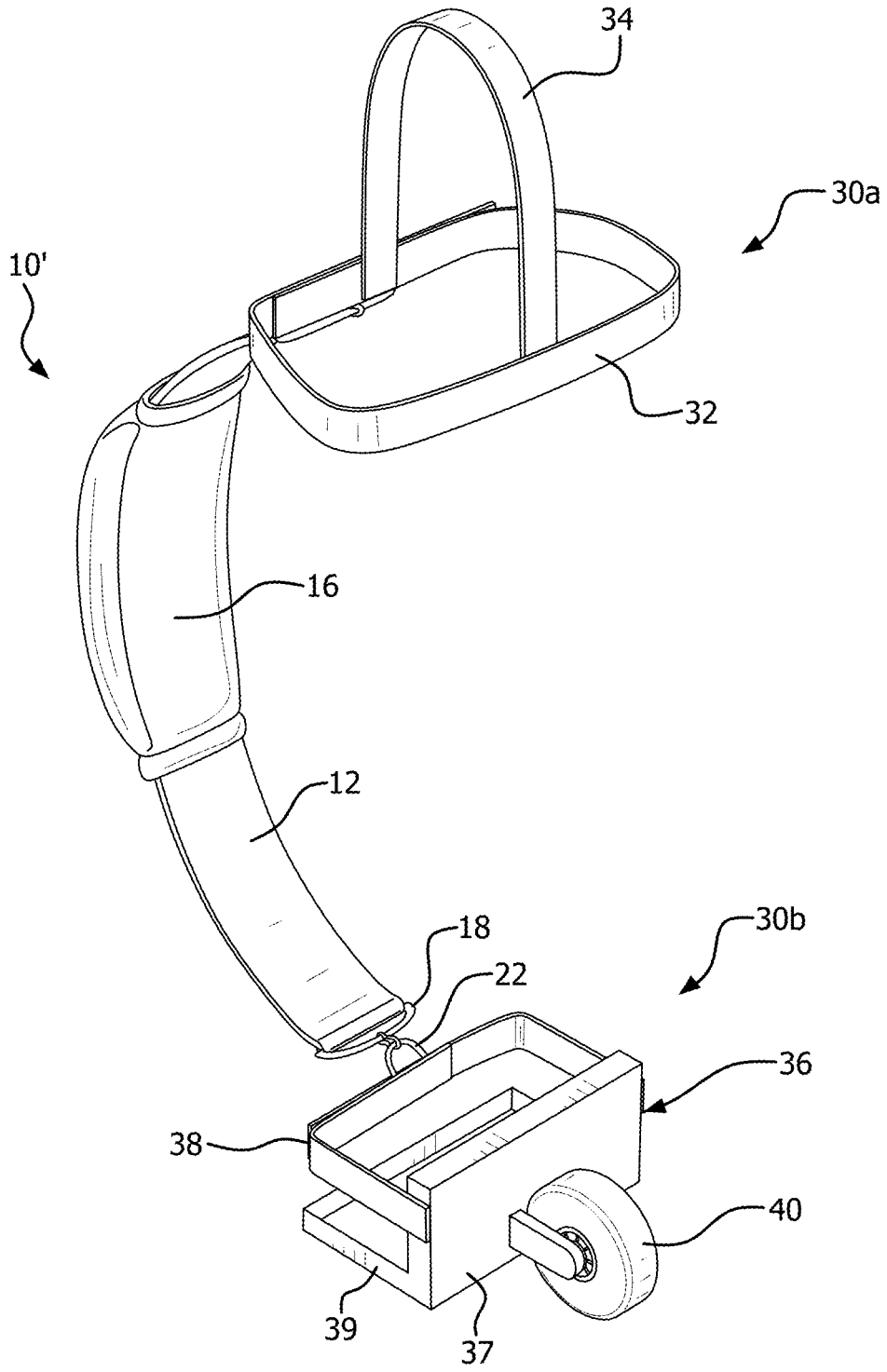
FIG. 6 is a front perspective view of the carry handle the invention according to FIG. 4.
Figure 7:
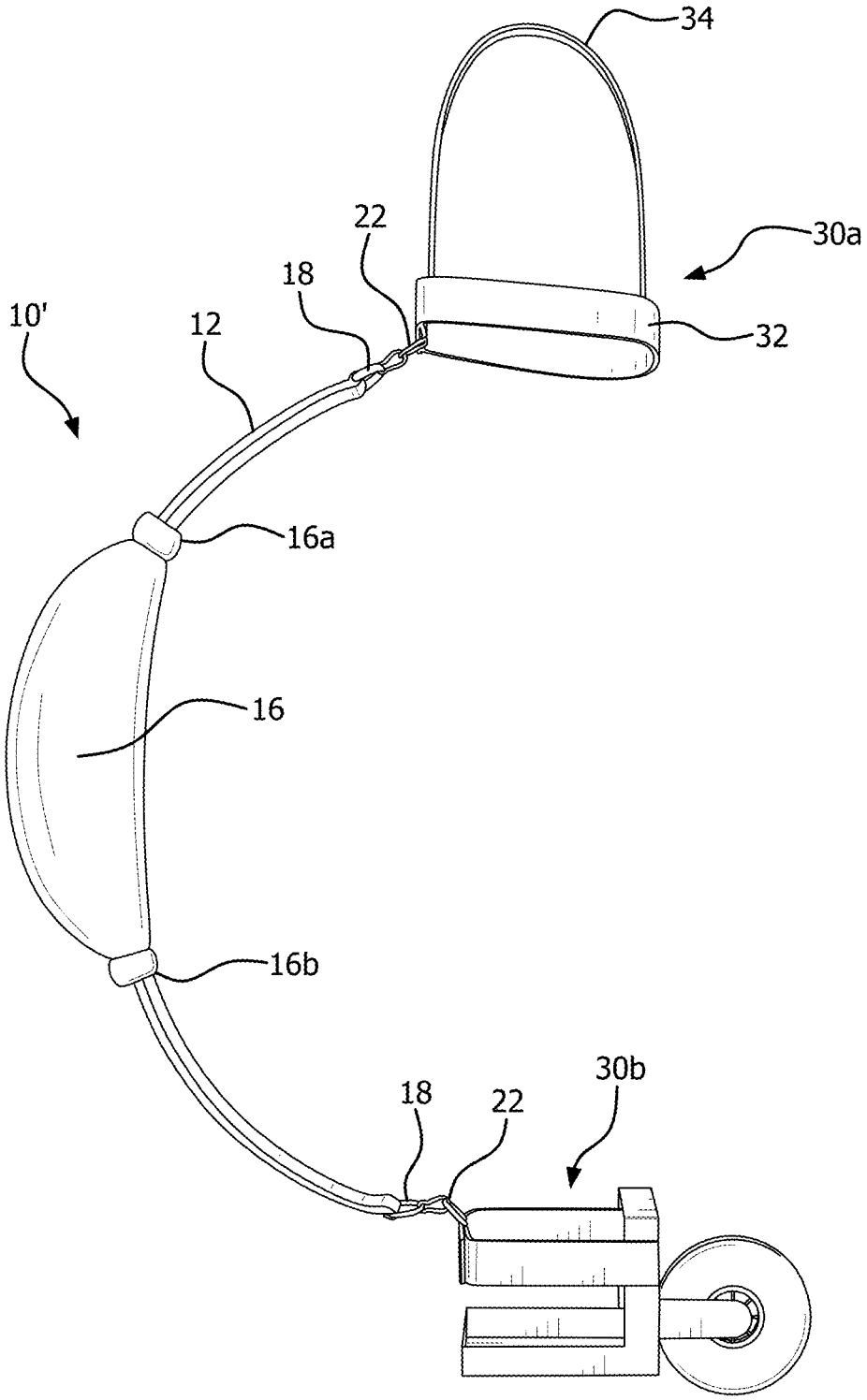
FIG. 7 is side view of the carry handle the invention according to FIG. 4.

FIGS. 5 to 7 show an alternate embodiment of the carrying/handle 10' where like reference numerals refer to similar elements. A flexible, adjustable holding top strap assembly 30*a* and a bottom support assembly 30*b* is provided to hold the bulky article(s) 100 to be carried. Holding strap assembly 30*a* is provided with an intermediately located loop connector 22 which cooperates with the detachable fastener 18 to attach the holding strap assembly 30*a* to the carrying strap 12, as best seen in FIG. 7. The adjustable top holding strap 30*a* preferably includes a hook and loop fastener located on one or both sides of the adjustable top holding strap 30*a* to adjustably secure the carry handle 10' to the bulky article 100.

The top holding strap assembly 30*a* is provided at one end of strap with a flexible strap 32 similar to element 20*a* in FIGS. 1 to 4. A longitudinally extending strap 34 extends from flexible strap 32 for securing the carrying handle 10' to the bulky article 100, especially to secure a plurality of bulky article(s) 100 and to serve as a handle for aiding the user to pull the carried one or more bulky articles when the wheels or casters 40 are employed, as described below.

The bottom support assembly 30*b* comprises an L-shaped bracket 36 having one or more wheels or casters 40 provided on an underside of the bracket 36 to help support the weight of the carried articles. The L-shaped bracket 36 may be fabricated from a plastic material, a metal material, or the like. It is contemplated that the bracket 36 comprises a first leg 37 to which the caster 40 is attached on an underside and serves as a supporting surface for the bulky article 100 being carried and a second leg 39 extending normally from the first leg and serving as a side supporting surface for the bulky article(s). A holding strap 38 whose both ends are attached to the first leg 37 forming a loop for further holding the bulky article 100 in is also provided. The holding strap 38 is also provided with an intermediately located loop connector 22 which cooperates with the detachable fastener 18 to attach the bottom support assembly 30*b* to the carrying strap 12, as described in greater detail above.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A carry handle for carrying one or more bulky articles comprising:

a carrying strap, the carrying strap having a first end and a second end located opposite the first end the carrying strap being adjustable to adapt to users of different sizes;

a top holding strap configured to be secured around the one or more bulky articles, the top holding strap being attached to the first end of the carrying strap via a mechanical connector for securing the one or more bulky articles, the top holding strap being adjustable to fittingly secure the top holding strap around the one or more bulky articles, the top holding strap comprising a hook and loop fastener for adjustably securing the top holding strap to the one or more bulky articles and a handle extending therefrom for the user to facilitate the transport of the one or more bulky articles; and a bottom support assembly, the bottom support assembly having an L-shaped configuration to provide side and bottom support for the one or more bulky articles, the bottom support assembly comprising a first planar wall for providing the side support and a second planar wall extending perpendicular from the first planar wall for providing the bottom support for supporting the one or more bulky articles thereon, one or more wheels attached to an underside of the first planar wall to aid in transporting the one or more bulky articles, the one or more wheels extending perpendicular from the first planar wall, and a bottom holding strap attached to the first planar wall and which is adjustable to fittingly secure the bottom holding strap around the one or more bulky articles;

whereby the one or more bulky articles may be transported by a user.

2. The carry handle according to claim 1 wherein the carrying strap further comprises an intermediate padded portion and wherein mechanical fasteners disposed on each end of the carrying strap serve to removably attach the carrying strap to the top holding strap and the bottom support assembly.

3. The carry handle according to claim 1 wherein each end of the bottom holding strap is attached to and extends from the first planar wall and comprises a hook and loop fastener for adjustably securing the bottom holding strap to the one or more bulky articles.

4. The carry handle according to claim 3 wherein the mechanical fastener for the bottom support assembly is attached to the middle of the bottom holding strap between the ends of the bottom holding strap.

* * * * *